US005669515A

United States Patent [19]

Tisbo et al.

[11] Patent Number: 5,669,515

[45] Date of Patent: Sep. 23, 1997

[54] TOOL HANGER

[75] Inventors: Thomas A. Tisbo, Barrington Hills; Stephen P. Whitehead, Elgin, both of Ill.

[73] Assignee: Suncast Corporation, Batavia, Ill.

[21] Appl. No.: 513,382

[22] Filed: Aug. 11, 1995

[51] Int. Cl.[6] ..... A47F 7/00

[52] U.S. Cl. ..... 211/70.6; 211/66; 211/87

[58] Field of Search ..... 211/70.6, 70.1, 211/60.1, 70.5, 65, 66, 87; 248/316.8

[56] References Cited

U.S. PATENT DOCUMENTS

| | | | |
|---|---|---|---|
| 3,002,666 | 10/1961 | Silverman | 211/87 X |
| 3,187,902 | 6/1965 | Nelson | 211/70.6 |
| 3,650,407 | 3/1972 | Benham | 211/87 X |
| 4,343,172 | 8/1982 | Nordlund | 211/70.1 X |
| 4,410,095 | 10/1983 | Dembicks | 211/70.6 |
| 4,778,065 | 10/1988 | Chiavot | 211/65 |
| 5,097,966 | 3/1992 | Miller | 211/70.6 X |

FOREIGN PATENT DOCUMENTS

| | | | |
|---|---|---|---|
| 2025273 | 12/1971 | Germany | 211/70.6 |

*Primary Examiner*—Robert W. Gibson, Jr.
*Attorney, Agent, or Firm*—McHale & Slavin, P.A.

[57] ABSTRACT

The instant invention is a tool rack constructed from a single piece of plastic having provisions for securing a variety of tool sizes on outwardly extending support members. The tool hanger has provisions to allow for nesting of multiple tool hangers for purposes of storage and shipping. In addition, multiple tool hangers may be placed adjacent to each other by use of an interlocking type adjoinment which can be secured to a stud surface by nails, screws or the like fasteners. Aperture holes are provided in combinations of 8" derivatives allowing for coupling to twenty-four or sixteen inch centers.

14 Claims, 2 Drawing Sheets

TOOL HANGER

FIELD OF THE INVENTION

This invention relates to hanging devices and in particular to a one-piece stackable tool hanger.

BACKGROUND OF THE INVENTION

Various devices exist for hanging tools in the storage areas of residential and commercial properties. Tool hanging devices allow organization of these tools within such storage areas thereby further providing a position where the tools cannot be damaged nor be in harms way. For example, a typical household garage has various tools such as racks, shovels, brooms, and so forth that cannot be readily stored. If left on the floor, these tools must be leaned against a wall, taking up valuable floor space and presenting a situation in which a person may accidently trip over them. In addition, tools placed directly on a floor surface are susceptible to early degradation as surface moisture will rust or oxidize metal tools. Placement of brooms on a floor surface allows the bristles to collect debris. For these reasons, various types of tool racks have been marketed with various types of success.

One of the problems with prior art tool devices is the lack of proper support for tools having various size tool ends or supporting handles. In addition, residential and commercial structures have support beams that may be placed at sixteen or twenty-four inch centers. In those instances, provisions must be made for support along the spaced apart centers to provide proper spacing for anchoring purposes. Thus, what is lacking in the art is a low cost tool hanger having provisions for support of various tools on variably sized support beams.

SUMMARY OF THE INVENTION

The invention consists of a twenty-four or forty-eight inch single piece rigid plastic support rack having multiple sets of support members projecting from a side surface. A tongue and receptacle end design allows for coupling additional support racks on either end. The support members include a structural shape having provisions for accommodating variably sized tools. The support members are hollow thereby allowing multiple racks to be stacked for storage and shipping purposes. In addition, the angular placement of the support members allows for eliminating a step in plastic manufacturing.

Thus, an objective of the instant invention is to provide a low cost, structurally supportive tool rack having provisions for mounting on sixteen or twenty-four inch construction supports.

Still another objective of the instant invention is to provide a tongue and receptacle type shape allowing for the addition of tool racks in a complementing fashion so as to take advantage of securement to the sixteen or twenty-four inch support.

Still another objective of the instant invention is to provide a support member having a shape conveniently allowing for stacking of racks on top of each other for ease of shipping and storage purposes.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Although the invention is described in terms of a specific embodiment, it will be readily apparent to those skilled in this art that various modifications, rearrangements and substitutions can be made without departing from the spirit of the invention. The scope of the invention is defined by the claims appended hereto.

Figure 1:
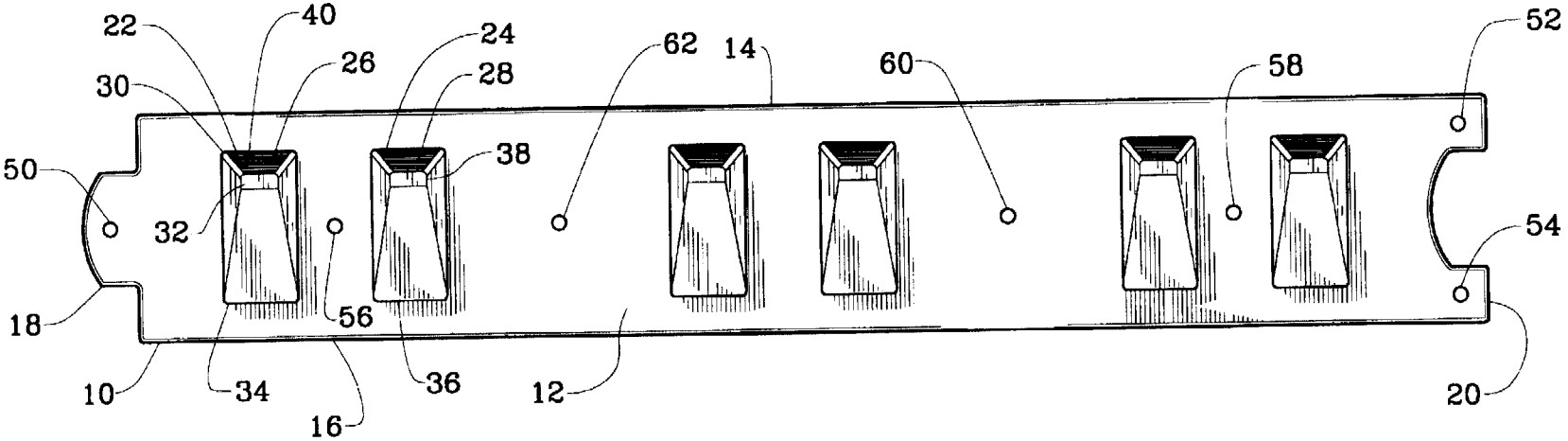
FIG. 1 is a front plane view of one embodiment of the instant invention.

Now referring to FIG. 1, set forth is a tool rack of the instant invention 10 having a front surface 12 a first side 14 second side 16 an insertion end 18 and a receptive end 20. The first side 12 includes spaced apart support members 22 and 24 so as to provide a cavity therebetween allowing tools to rest on an upper surface 26 and 28 respectively. A proximal end 30 of each support member is of a first width which narrows to a distal end 32 of a second width. Similarly, a lower end 34 of first member 22 and lower end 36 of second member 24 is of a first width which is wider than distal end 32 and 38 of each support member. The upper surface 26 includes a plurality of raised ridges 40 which provide frictional engagement for items placed thereon. The insertion end 18 includes aperture 50 which is spaced apart from receptive end 20 having apertures 52 and 54 by a distance of twenty-four inches. This allows the spacing of the support unit on twenty-four inch centers. On a forty-eight inch embodiment the spacing between aperture holes 50 and an imaginary line drawn vertically through holes 52 and 54 would be forty-eight inches allowing securement between twenty-four inch centers along three positions namely the insertion end of one rack, the receptive end on a second rack and the combined insertion and receptive mounting apertures of the adjoining device. Aperture 56 and 58 are spaced apart by sixteen inches allowing for placement on sixteen inch centers with maximum support closest to the support members. Mounting aperture 60 is spaced apart from mounting aperture 50 by a total of sixteen inches allowing for offset mounting as well as aperture 62 being spaced apart from aperture 52 and 54 by sixteen inches allowing for offset placement. The location of the mounting holes provides unique flexibility for mounting purposes.

Figure 2:
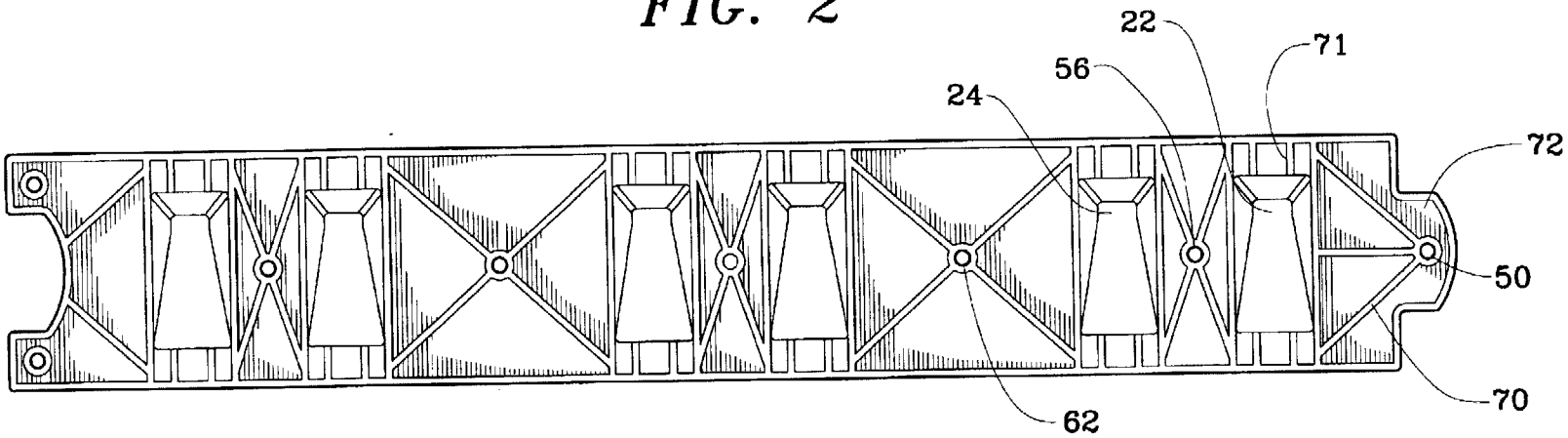
FIG. 2 is a rear plane view.

Now referring to FIG. 2, shown is a rear view of FIG. 1 having aperture reinforcement ridges 70 extending outwardly from aperture hole 50 providing structural support to the rear 72 of the frontal side surface shown on FIG. 1 as numeral 12. Raised ridges 71 provide support throughout the backing mechanism to first support member 22, aperture 56, second support member 24, aperture 62, and the remaining spaced apart support members and mounting apertures.

Figure 3:
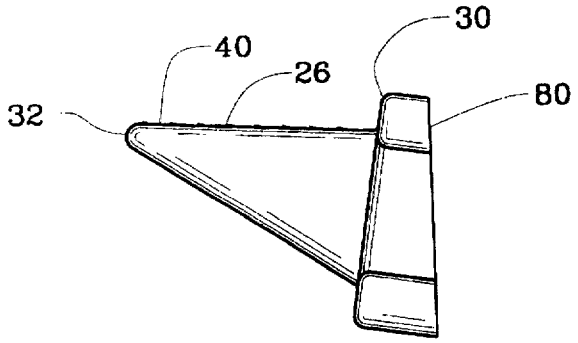
FIG. 3 is a side view.
Figure 4:
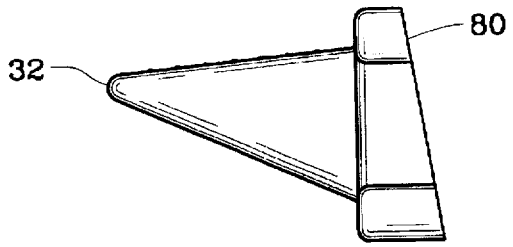
FIG. 4 depicts side view as it is ejected from a mold.

Now referring to FIG. 3, shown is the end view of the tool hanger 10 having a rear mounting surface 80 which is substantially vertical allowing for ease of mounting against a flush surface with an angular rotational allowing for formation of the upper surface 26 at a substantially perpendicular plane to mounting surface 80. As shown in FIG. 4, the use of the angled surface 80 allows for removal from a mold in such a manner so as to eliminate the need for lifting of the support member clear of the mold.

Figure 5:
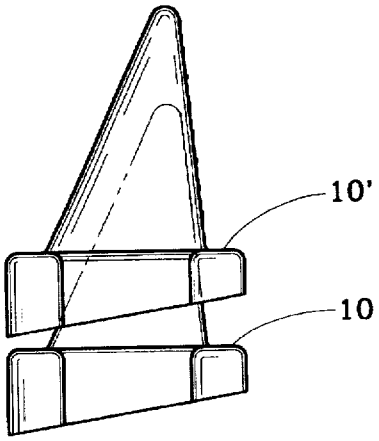
FIG. 5 is an end view of two racks stacked and placed in a storage position.
Figure 6:
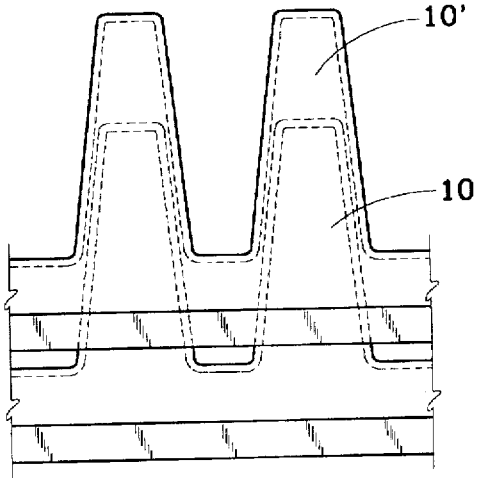
FIG. 6 is a cross sectional side view of two racks placed in a stacked position.

Referring to FIGS. 5 and 6, shown respectively are an end view and cross sectional side view of the tool racks 10 and 10' stacked on top of each other allowing for low cost shipping and storage. The support members each include sufficient dimensional aspects so as to allow an adjoining unit to securely be positioned within an adjacent tool rack to allow for stability during storage and shipping. The approximate overall height of a tool rack is approximately 5.6" yet allowing for the nesting the overall height of two tool racks stacked on top of each other approximate 7.2".

It is to be understood that while we have illustrated and described certain forms of our invention, it is not to be limited to the specific forms or arrangement of parts herein described and shown. It will be readily apparent to those skilled in the art that various changes may be made without departing from the scope of the invention and the invention is not to be considered limited to what is shown in the drawings and described in the specification.

What is claimed is:

1. A tool rack comprising:

a support base having a rectangular shape with a first end, a second end, a front surface, a rear surface, and first and second side edges;

said front surface of said support base having a plurality of outwardly extending support members, said first side edge of said support base having a width less than a width of said second side edge for positioning said outwardly extending support members and said front surface at an inclined angle relative to said rear surface;

means for coupling said support base to a similarly shaped support base;

wherein said tool rack is secured to a wall and expandable in length by the juxtaposition of an adjoining tool rack to form a continuous rack by interlocking said first and second ends of an adjoining tool rack.

2. The tool rack according to claim 1 wherein said rear surface of said support base and said outwardly extending support members is recessed wherein said tool rack is stackable with other similar shaped tool racks for storage by inserting said outwardly extending support members of one tool rack into corresponding recesses of said rear surface on another tool rack.

3. The tool rack according to claim 1 wherein said outwardly extending support members includes a series of raised ridges on an upper surface of each said support member.

4. The tool rack according to claim 1 wherein said support base includes mounting apertures placed at nominal intervals along the length of said support base thereby allowing optimal anchoring to a supporting surface.

5. The tool rack according to claim 4 wherein said nominal interval is approximately eight inches.

6. The tool rack according to claim 1 wherein said means for coupling said support base is defined as a projection extending from said first end in the lengthwise direction of said support member means and a receptive end formed within said second end, wherein said projection and said receptive end are capable of frictional engagement.

7. The tool rack according to claim 6 which further includes a mounting aperture through said projection and said receptive end, wherein said engaged ends can be further secured together by mounting them to a common structure.

8. The tool rack according to claim 2, wherein said support bases are identically formed to facilitate stacking.

9. The tool rack according to claim 4 wherein said mounting apertures are spaced apart in accordance with conventional wall stud placement.

10. A tool rack comprising:

a support base having a rectangular shape with a first end, a second end, a front surface, a rear surface, and first and second side edges;

said front surface of said support base having a plurality of outwardly extending support members, said first side edge of said support base having a width less than a width of said second side edge for positioning outwardly extending support members and said front surface at an inclined angle relative to said rear surface;

a projection extending from said first end in the lengthwise direction of said support member means and a receptive end formed within said second end, wherein said projection and said receptive end are capable of frictional engagement to a similarly shaped support base;

a plurality of mounting apertures placed at nominal intervals along the length of said support base for receipt of fasteners for securing said support base to a supporting surface, wherein said tool rack is secured to a wall and expandable in length by the juxtaposition of an adjoining tool rack to form a continuous rack by interlocking said first and second ends of an adjoining tool rack.

11. The tool rack according to claim 10 wherein said rear surface of said support base and said outwardly extending support members is recessed wherein said tool rack is stackable with other similar shaped tool racks for storage by inserting said outwardly extending support members of one tool rack into corresponding recesses of said rear surface on another tool rack.

12. The tool rack according to claim 10 wherein said outwardly extending support members includes a series of raised ridges on an upper surface of each said support members.

13. The tool rack according to claim 10, wherein said support bases are identically formed to facilitate stacking.

14. The tool rack according to claim 10 wherein said mounting apertures are spaced apart in accordance with conventional wall stud placement.

* * * * *